United States Patent [19]

Love

[11] 3,982,700

[45] Sept. 28, 1976

[54] MIXING DEVICES

[76] Inventor: Gordon David Love, Waterside, Chesham, Buckinghamshire, England

[22] Filed: Apr. 3, 1975

[21] Appl. No.: 564,802

[30] Foreign Application Priority Data

Apr. 3, 1974 United Kingdom ..... 14812/74

[52] U.S. Cl. ..... 241/46.11; 241/86.1; 241/154; 241/185 A

[51] Int. Cl.[2] ..... B02C 23/36

[58] Field of Search ..... 241/43, 45, 46 R, 46.06, 241/46.11, 73, 86.1, 154, 188 R, 185 A; 415/121 B

[56] References Cited

UNITED STATES PATENTS

| | | | |
|---|---|---|---|
| 2,808,089 | 10/1957 | Gerardin | 241/46.11 X |
| 2,846,152 | 8/1958 | Brophy | 241/43 |
| 3,155,046 | 11/1964 | Vaughan | 415/121 B |
| 3,724,765 | 4/1973 | Rohrbaugh et al. | 241/188 R |
| 3,866,841 | 2/1975 | Iwahara | 241/46.11 |

*Primary Examiner*—Granville Y. Custer, Jr.
*Attorney, Agent, or Firm*—Browdy and Neimark

[57] ABSTRACT

A mixing device comprising cooperating rotor and stator elements wherein a stator blade is arranged at the inlet to the stator element for cooperation with an axially outer end of at least one rotor blade. In use, fibrous material which is drawn into the stator element by rotation of the rotor element is shredded by the action of the cooperating rotor and stator blades. The material is then expelled radially outwardly from the stator element and is subjected to high shearing forces, which effect further mixing and disintegration, as it passes between a radially center edge of a rotor blade and the stator elements.

7 Claims, 5 Drawing Figures

MIXING DEVICES

This invention relates to mixing devices.

According to the invention a mixing device comprises cooperating rotor and stator elements of which the rotor element is adapted, upon rotation, to draw material axially into the stator element via an inlet at one end thereof and then to expel material radially outwardly via outlet means provided in the stator element, wherein the stator element includes a stator blade which is arranged at the inlet to the element for cooperation with an axially outer end of a rotor blade, whereby, in use fibrous material entering the stator element is shredded by the action of the cooperating rotor and stator blades and is then subjected to high shearing forces in moving radially outwardly between a radially outer edge of a rotor blade and the stator element.

The invention will now be described, by way of example, with reference to the accompanying drawings, of which:

Figure 1:
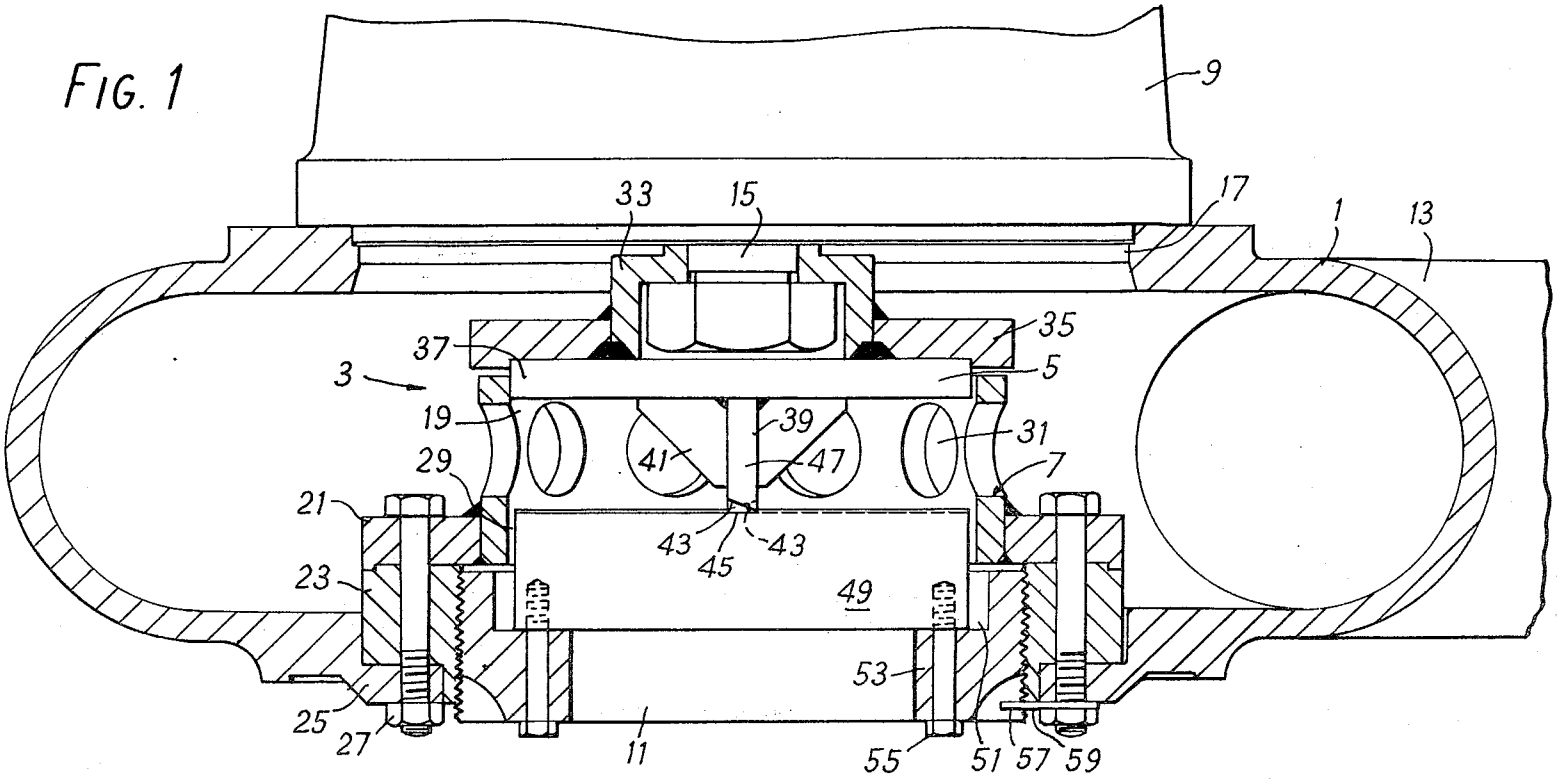
FIG. 1 is an axial section of a first mixing device according to the present invention.

The mixing device of FIG. 1 is suitable for pumping a mixture of a liquid and a solid from one location to another and at the same time subjecting the solid to disintegration and mixing with the liquid. The device is particularly suitable for pumping sewage from an open gulley to a disposal pipe.

Included in the present device is a mixer casing 1, a mixing head 3 which is formed of cooperating rotor and stator elements 5 and 7, respectively, and is mounted inside the casing 1, and an electric motor 9 for driving the rotor element.

The mixer casing 1 is generally bulbous in shape, but flattened to provide an axial dimension which is small relative to the radial dimension thereof. An inlet 11 for liquid and solid material is formed in a bottom wall of the casing 1, coaxially thereof, and an outlet pipe 13 is connected to an upper part of the casing. The motor 9 is mounted on a top wall of the casing 1 with its shaft 15 extending downwardly into the casing via a further aperture 17 in the top wall.

The mixing head 3 is arranged coaxially of the mixer casing 1 with the stator element 7 supported by the bottom wall of the casing and the rotor element 5 supported from above by the motor shaft 15.

The stator element 7 has a cylindrical side wall 19 which has an external mounting flange 21 at its lower end. This flange 21 at the lower end of the element 7 is supported by a spacer ring 23 which is itself supported on a flange 25 formed internally about the inlet 11 to the mixer casing 1. Six bolts 27 secure the stator element 7 to the casing 1, each bolt extending through aligned apertures in the flange 25, the spacer ring 23, and the flange 21 on the stator element.

The stator element 7 is open at its lower end to provide an inlet 29 for material flowing through the inlet 11 to the casing 1. Outlet from the stator element 7 is provided by a series of circular apertures 31 which are equi-angularly spaced about the side wall 19 of the element.

An adaptor 33 for securing the rotor element 5 to the motor shaft 15 includes a supporting plate 35 formed with a circular recess in its under surface. A backing disc 37 of the element 5 is fitted into this recess and secured to the supporting plate 35 by four bolts (not shown).

Depending from the under surface of the rotor backing disc 37 is an upstanding plate 39 which extends diametrically across the disc and is supported by gussets 41 on respective opposite sides thereof.

The lower side of the plate 39 is bevelled to form a pair of cutting edges 43 which are located at respective opposite sides of the plate and spaced lengthwise of the plate by a central land 45. The plate 39 forms therefore two aligned rotor blades 47, each having a cutting edge 43 at the lower side thereof.

The rotor element 5 is arranged with its backing disc 37 extending downwardly a short distance into the stator element 7 and the rotor blades 47 at a vertical location corresponding to the vertical location of the outlet apertures 31 in the stator side wall 19. The external diameter of the rotor backing disc 37 and blades 47 is slightly less than the internal diameter of the stator side wall 19. The supporting plate 35 in the adaptor 33 is located a short distance above, and extends radially outwardly of, the side wall 19.

Cooperable with the cutting edges 43 in the rotor element 5 is a stator blade 49 which extends across the inlet 29 to the stator element 7. The ends of this blade 49 are fitted into upstanding slots 51 formed at diametrically opposed locations in an inner side wall of a mounting ring 53 and the blade 49 and ring 53 are secured together by a pair of bolts 55, each extending through an aperture in the ring and engaged in a threaded aperture in the blade.

The mounting ring 53 is externally threaded and is engaged with threads formed internally of the spacer ring 23 supporting the side wall 19 of the stator element 7. The position of the mounting ring 53 is adjusted so that the upper edge of the stator blade 49 just contacts the land 45 at the center of the plate 39 forming the rotor blades 47. To enable the ring 53 to be locked in the correct position a series of 12 equi-angularly spaced slots 57 are provided in the periphery of the ring and a tab washer 59 is provided on one or more of the bolts 27 securing the stator element 7 and spacer ring 23 to the mixer casing. Once the mounting ring 53 is in the correct angular position one of the bolts 27 is loosened, the mounting ring is moved slightly, if necessary, to bring a slot 57 and a washer 59 into radial alignment, and the bolt 27 is then tightened. Engagement between the washer 59 and the slot 57 then prevents rotation of the mounting ring 53.

In use, the mixer casing 1 is immersed in sewage in a gulley and a disposal pipe is connected to the outlet pipe 13 from the casing.

Upon energizing the motor 9 the rotor element 5 is rotated within the stator element 7 and material within the element 7 is expelled radially outwardly via the outlet apertures 31 in the side wall 19. The radially outer edge of each rotor blade 47 is adjacent to the inner surface of the stator wall 19 and the material is subjected to strong shearing forces as it passes between the blades 47 and the wall 19 and in passing through the apertures 31 in the wall. This causes disintegration of solid material and thorough mixing with the liquid. Additional liquid and solids are drawn upwardly into the stator element 7 to replace the material expelled by the action of the rotor blades 47.

In moving upwardly into the mixer casing 1 material has to pass the blade 49 at the inlet 29 to the stator element 7. Cooperating with this blade 49 are the cutting edges 43 at the lower sides of the rotor blades 47. Accordingly, as solid material moves upwardly past the stator blade 49 it is engaged between this blade and the rotating cutting edges 43 and is cropped. The cropping action is particularly noticeable and important with regard to solid material in the form of fibers. Without the stator blade 49 and cutting edges 43 of the rotor blades 47 such material tends to wind around the rotor element 5, leading to reduced efficiency or even stoppage of the device. The presence of the blade 49 and cutting edges 43 ensures that the fibrous material is reduced to a size where there is no significant winding action. Instead, the remains of the fibers are expelled from the stator element 7 and subjected to mixing and disintegration in the same manner as the remaining solids.

Figure 2:
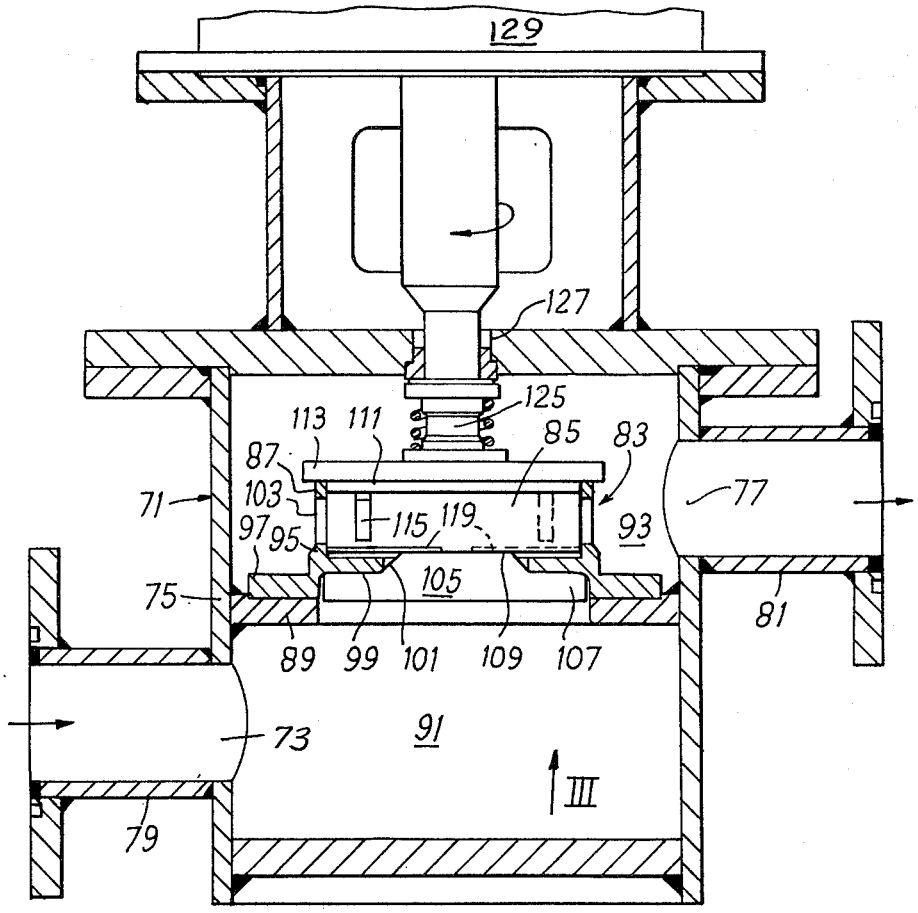
FIG. 2 is an axial section of a second mixing device according to the present invention.

Referring now to FIG. 2 of the drawings, a second device according to the present invention is used for mixing and disintegrating solid material in a mixture of liquids and solids which is being conveyed along a pipeline. The device also serves to exert a pumping action which enhances the flow of material along the pipeline.

The present device is provided with an upstanding housing 71 having an inlet port 73 in a lower part of a cylindrical side wall 75 thereof and an outlet port 77 at a diametrically opposed location in an upper part of the wall 75. Flanged inlet and outlet pipes 79 and 81, respectively, are connected to respective inlet and outlet ports 73 and 77 so that the housing 71 is readily connected into an existing pipeline. A mixing head 83 made up of a rotor element 85 and a stator element 87 is mounted inside the housing 71.

An annular plate 89 for supporting the stator element 87 of the mixing head 83 is welded to the side wall 75 of the housing 71 at a vertical location intermediate the vertical locations of the inlet pipe 79 and the outlet pipe 81. The plate 89 serves to define a lower inlet chamber 91 and an upper outlet chamber 93 within the housing 71.

The stator element 87 of the present device has a cylindrical side wall 95 which is formed with an external mounting flange 97 at its lower end. Internally of the side wall 95 a further flange 99 is provided immediately above the mounting flange 97. The element 87 is mounted within the outlet chamber 93, coaxially of the housing 71, with the mounting flange 97 fitted into an annular recess in the supporting plate 89 and secured to the plate by bolts (not shown).

An inlet 101 for material to the stator element 87 is provided by the central aperture in the internal flange 99. Outlet from the element 87 is provided by a series of upstanding slots 103 in the side wall 95 of the element, these slots opening into the outlet chamber 93.

Extending across the inlet 101 to the stator element 87 is an upstanding stator blade 105. This blade 105 is formed of two end sections 107 which are welded to the under surface of the internal flange 99 in the stator element 87 and a central part which extends upwardly, through the central aperture in the flange, to a vertical location a short distance above the flange 99. A cutting edge 109 is formed along the upper side of the central part of the stator blade 105.

Figure 3:
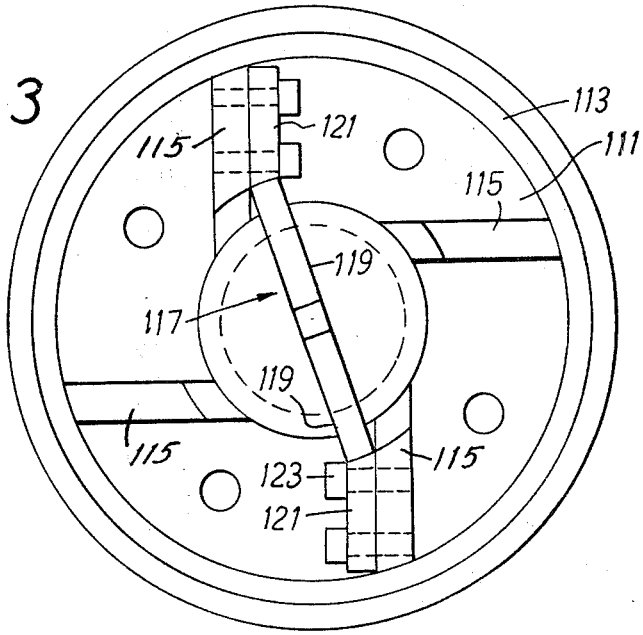
FIG. 3 is a rotor element in the device of FIG. 2, viewed in the direction of the arrow III.

Referring to FIGS. 2 and 3, the rotor element 85 of the present device includes a rotor disc 111 which is set into the lower surface of a backing plate 113 and has four rotor blades 115 depending therefrom. The blades 115 are equi-angularly spaced about the axis of the rotor disc 11, each extending inwardly from the periphery of the disc, at an inclination to the radius, to a location radially spaced from the axis of the disc.

The rotor element 85 is also provided with an additional plate 117 which extends across the rotor disc 111 between an opposed pair of the rotor blades 115. The plate 117 is formed of a central section whose lower side is bevelled so that the section forms two aligned blades 119 and two outer sections 121 which are for mounting purposes. Each outer section 121 is cranked relative to the central section and is secured to a rotor blade 115 by a pair of screws 123. The angle between each outer section 121 of the plurality and the central section is such that the blades 119 extend diametrically across the rotor disc 111.

Referring to FIG. 2, the backing disc 113 of the rotor element 85 is secured to a lower end of a motor shaft 125 which extends downwardly via an aperture 127 in a top wall of the housing 71 from a motor 129 mounted on top of the housing. The rotor disc 111 has a diameter slightly smaller than the internal diameter of the stator side wall 87 and is received within the upper end of the wall. The external diameter of the backing disc 113 is greater than the external diameter of the stator side wall 87 and the backing disc is arranged with its under surface a short distance above the side wall.

In use, the housing 71 of the present device is connected into a pipeline in the manner described above and the motor 129 is energized to rotate the rotor element 85. Liquid and solid material in the pipeline is drawn into the inlet chamber 91 from the inlet pipe 79 and is then drawn upwardly into the stator element 87.

Material within the stator element 87 is expelled radially outwardly via the outlet slots 103 to the outlet chamber 93, and from there to the outlet pipe 81.

In moving upwardly from the inlet chamber 91 to the stator element 87 fibrous material is engaged between the stator blade 105 and the cooperating rotor blades 119. This crops the material and reduces it to a size at which the material is not wound about the rotating rotor element 85.

During movement outwardly from the mixing head 83 material is subjected to high shearing forces as it passes between the rotor element 85 and stator element 87 and subsequently through the outlet slots 103 in the stator side wall 95. These forces disintegrate the solid material and effect thorough mixing of the solid with the liquid.

It will be appreciated that a mixing head of the form shown in FIG. 1 of the drawings can be employed in a mixing device for use in a pipeline, as in FIG. 2. Likewise a mixing head of the form shown in FIGS. 2 and 3 can be included in a mixing device for pumping material from an open gulley to a disposal pipe, as shown in FIG. 1.

Figure 4:
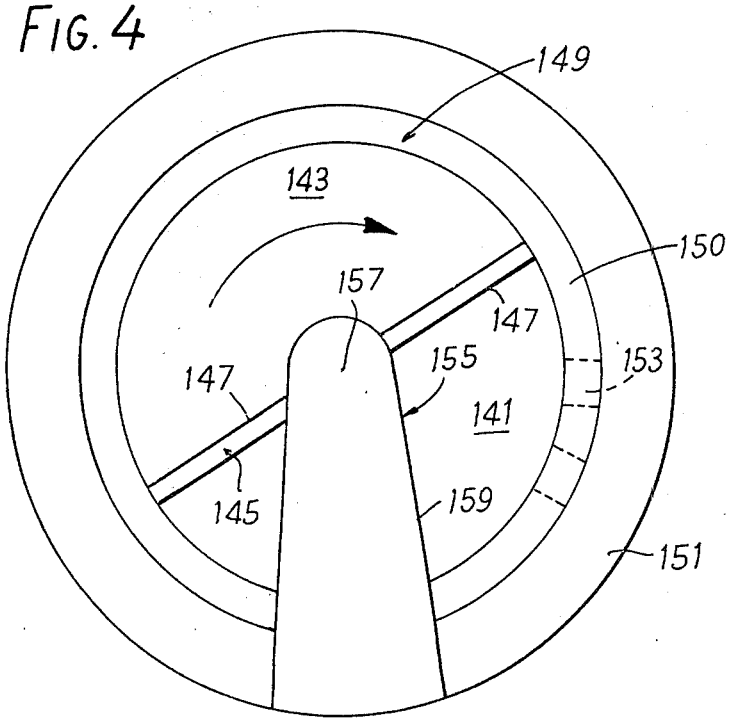
FIG. 4 is a mixing head in a third device according to the present invention, viewed in an axial direction.

FIG. 4 of the drawings shows a third mixing head according to the invention which can be included in a device for use in pumping material along a pipeline or from an open gulley.

Referring to FIG. 4, this third device has a rotor element 141 which includes a backing disc 143 and a plate 145 which is outstanding from the disc 143 and has an outer side thereof bevelled to form a pair of aligned rotor blades 147. A stator element 149 of the device includes a cylindrical side wall 150 which is formed with a mounting flange 51 and with outlet apertures 153. Also included in the stator element 149 is a blade element 155 which extends radially inwardly from the flange 151 and on to the axis 157 of the device. The element 155 has a cutting edge 159 and serves as a stator blade.

Figure 5:
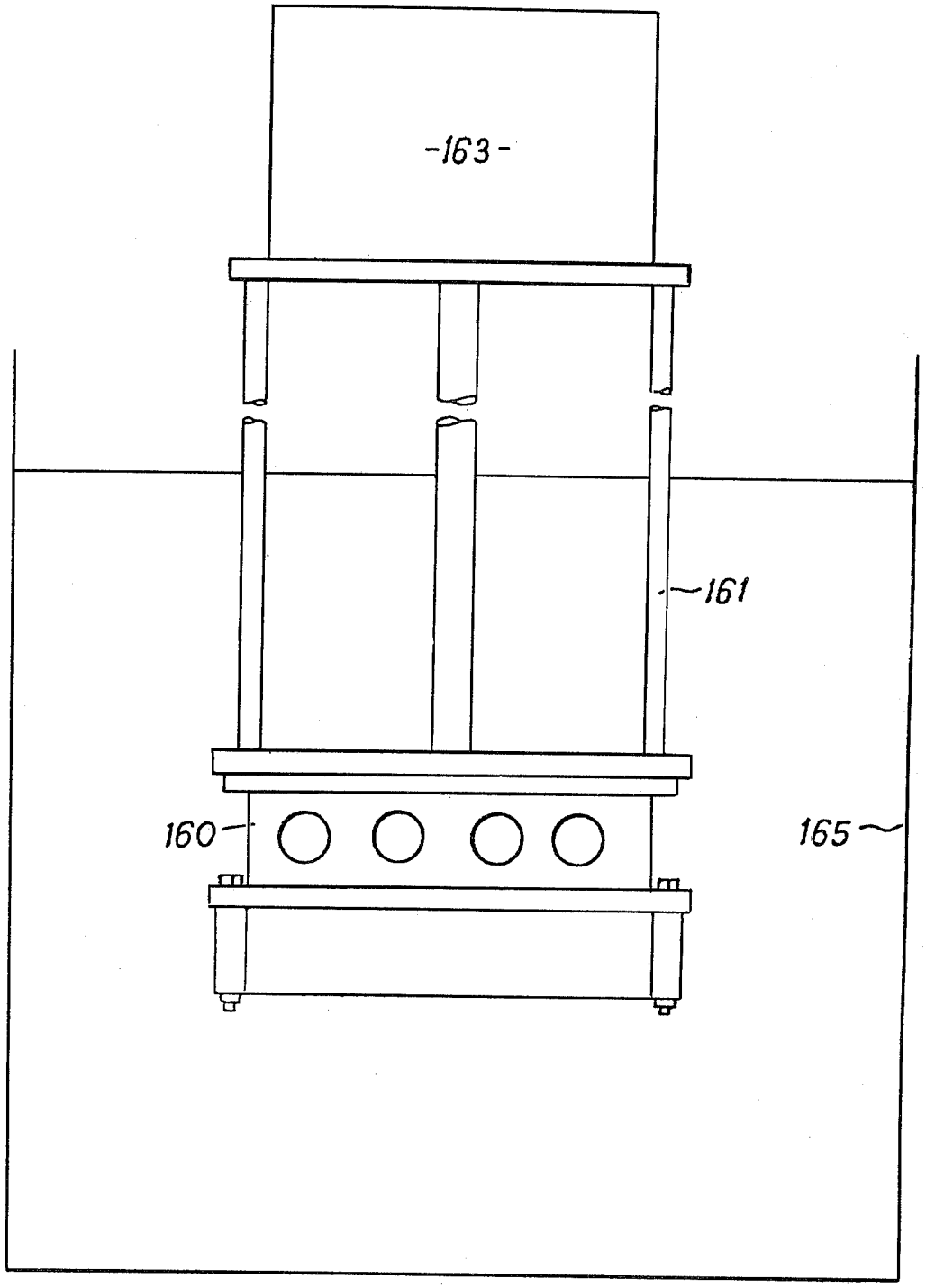
FIG. 5 is a side view of a further mixing device according to the present invention, which has no casing or housing surrounding the head.

In use of the device shown in FIG. 4 fibrous material is cropped by the cutting action of the rotor blades 147 and the cutting edge 159 of the cooperating stator blades. The fact that the blade element 155 extends on to the axis 157 of the device prevents a build up of material on the axis due to the vortex action set up by the rotation of rotor blades 147. Referring to FIG. 5, a mixing head 160, similar to each of the heads described above, can also be used in a device which has no casing or housing surrounding the head. Instead the head 160 is supported at the lower ends of pillars 161 which extend downwardly from a motor housing 163 into material within a mixing vessel 165. The head 160 itself is therefore in direct contact and communication with the material in the vessel.

I claim:

1. A mixing device, comprising:

a rotor element which comprises an elongated shaft, a rotor plate mounted on said shaft, and a plurality of rotor blades outstanding from one side of said rotor plate; and a stator element which comprises a generally cylindrical side wall having an inlet at one end of said cylinder, and outlet means formed in said side wall;

wherein said rotor element is arranged with said rotor blades within said stator element and on the side of said rotor plate facing said inlet;

wherein said stator element further includes a stator blade which extends diametrically across said inlet and is arranged for cooperation with an axially outer end of at least one of said blades;

whereby, in use, fibrous material entering said stator element is shredded by the action of the cooperating rotor and stator blades and is then subjected to high shearing forces in moving radially outwardly between a radially outer edge of at least one of said rotor blades and said side wall of said stator element.

2. A device as claimed in claim 1, wherein said stator blade is movable in an axial direction, thereby to allow adjustment of the position of said blade relative to at least one of said rotor blades.

3. A device as claimed in claim 2, wherein said stator blade is supported by a mounting ring, and said mounting ring threadably engages said stator element, whereby the position of said stator blade relative to at least one of said rotor blades is adjusted by rotating said mounting ring.

4. A device as claimed in claim 1, wherein said rotor blades include a pair of aligned rotor blades which extend diametrically across said rotor plate, an axially outer end of each of said pair of rotor blades cooperating with said stator blade to effect shredding of fibrous material when the device is in use.

5. A device as claimed in claim 1, wherein said rotor blades include a plurality of rotor blades which are equiangularly spaced about the axis of the device and each of which is outstanding from said rotor plate.

6. A mixing device in accordance with claim 1, wherein said rotor plate has a diameter at least as large as that of said cylindrical side wall of said stator element.

7. A mixing device in accordance with claim 1, wherein at least one of said rotor blades extends vertically from said rotor plate to a position in close proximity to the axially outer end of said stator blade, and laterally, substantially continuously, from a position in close proximity to a point on said stator side wall, through the axis of the device, to a second point on said stator side wall diametrically opposite the first point.

* * * * *